United States Patent [19]

Blanchard

[11] 4,382,653

[45] May 10, 1983

[54] CONNECTOR

[75] Inventor: Linden O. Blanchard, North Andover, Mass.

[73] Assignee: Avco Corporation, Wilmington, Mass.

[21] Appl. No.: 212,821

[22] Filed: Dec. 4, 1980

[51] Int. Cl.[3] ..... H01R 13/46; H01R 13/648

[52] U.S. Cl. ..... 339/143 R

[58] Field of Search ..... 339/143 R, 177 R, 143 T

[56] References Cited

U.S. PATENT DOCUMENTS

| | | | |
|---|---|---|---|
| 4,025,145 | 5/1977 | Shaffer et al. | 339/143 R |
| 4,090,767 | 5/1978 | Tregoning | 339/143 R |
| 4,109,222 | 8/1978 | Franco et al. | 339/143 R X |
| 4,131,332 | 12/1978 | Hogendobler et al. | 339/143 R X |
| 4,272,148 | 6/1981 | Knack, Jr. | 339/143 R |
| 4,330,166 | 5/1982 | Cooper et al. | 339/143 R |

*Primary Examiner*—Willie G. Abercrombie

*Attorney, Agent, or Firm*—Abraham Ogman

[57] ABSTRACT

A method and apparatus for grounding the individual wire shields of plural conductors in a cable when making electrical interconnections is described. A metallic disc is provided with ferrules to which the wire shields are affixed. The conductors are passed through the ferrules and interconnections made. The disc is then secured about its periphery to a backshell structure and then grounded.

7 Claims, 6 Drawing Figures

CONNECTOR

DESCRIPTION

1. Technical Field

The technical field is interconnection of electrical equipment.

2. Background Art

In the art of interconnecting electronic equipment it is customary to attempt to shield conductors from external transient surges which could be picked up on the conductors causing damage to the sensitive electrical equipment or at the very least, inserting extraneous noise into the circuit. Such shields are usually grounded so that such undesirable external transient surges are dissipated in a harmless fashion.

Normally, these extraneous surges are caused by signals of electrical origin, however, the possibility of gamma or X-ray radiation is also present and connectors must now be designed to withstand such radiation as well. One of the solutions for minimizing the effects of such radiation is to permeate the braided wires of the shield with a polymer filled emission suppression material capable of absorbing such radiation. Such material, however, is not a very good conductor, and, therefore, causes difficulties in grounding the shield since a good ground connection requires a low impedance connection.

Also when a number of conductors must be shielded, it is desirable that all conductor shields be grounded at a common plane providing for minimum inductance; otherwise extraneous noise will be induced in the circuit by the difference in potential between any two grounds.

It is also highly desirable that the ground plane be located as close as possible to the point of interconnection, i.e., the back pins of the connector.

INVENTION DISCLOSURE

In the apparatus of the present invention, connector apparatus is provided for circumferentially terminating and grounding the individual braided wire shields within a cable. This apparatus comprises an electrically conductive planar member in the form of a metal disc having a plurality of holes, one for each shielded wire in the cable. A plurality of electrically conductive tubular elements, such as metal ferrules, are adapted to be press-fit and embedded into said holes forming a good low-ohmic contact. The shields on each wire are electrically connected to a respective ferrule. In one embodiment, this electrical connection is made by means of heat-shrinkable tubing having an inner conductive lining. The tubing is placed over the shield and the ferrule and the tubing is heat shrunk joining the wire shields to the ferrule via the conductive lining. In another embodiment, a second outer metallic ferrule is provided which fits over the inner ferrule, i.e., the ferrule embedded in the disc. The wire shields are folded over the outside of the inner ferrule and the outer ferrule is pressed onto the inner ferrule holding the wire shield in place between the two ferrules.

In yet another embodiment, the inner ferrule is flared at one end and the holes in the disc are correspondingly tapered. The outer diameter of the non-flared portion of the ferrule is sufficient to accept the braided wire which fits snugly around the exterior of the knurled ferrule. The ferrule is then inserted in the flared hole retaining the braided wire securely between it and the disc.

After the shields are connected to the ferrules, the individual wire connections may be made to the back of a connector. Next, the disc is mechanically secured to the exterior of the connector and electrically grounded.

There is thus provided, in accordance with the invention, simple and relatively inexpensive apparatus for electrically grounding all the wire shields of a cable in a single plane in close proximity to the back of a connector jack or plug.

BEST MODE CONTEMPLATED

Figure 1:
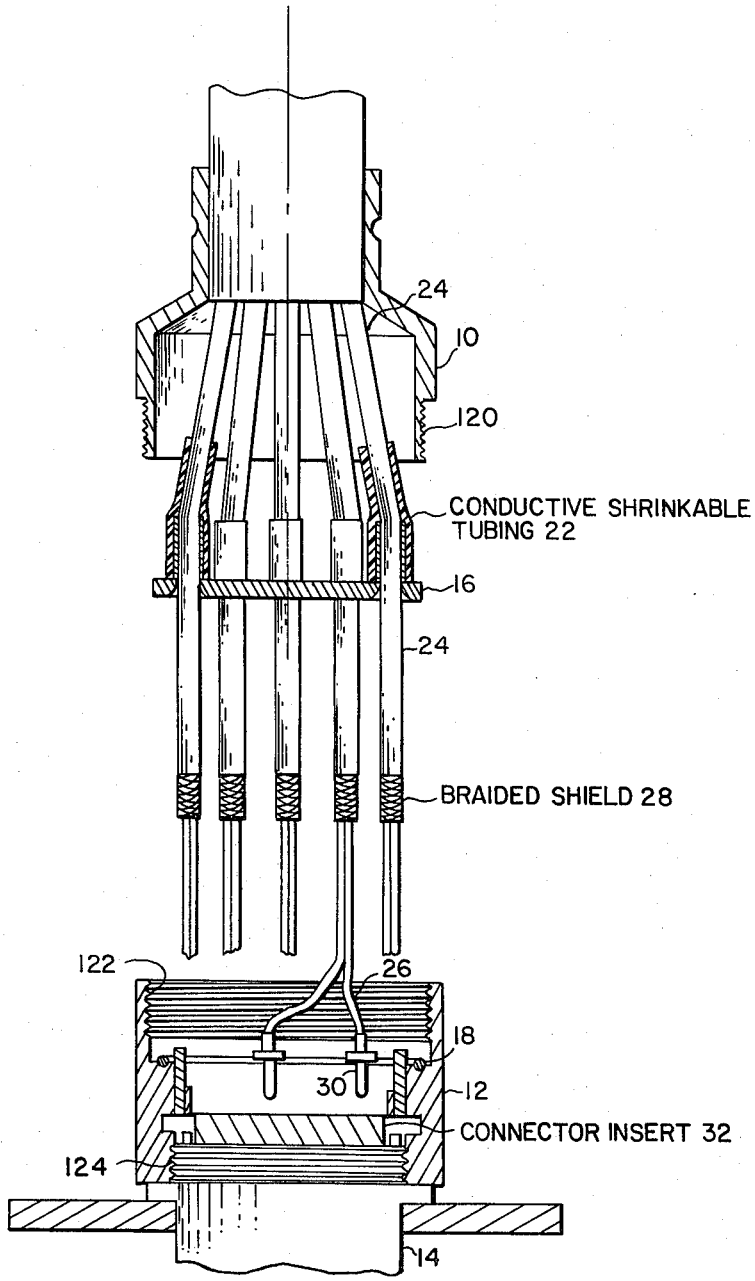
FIG. 1 is a sectional view of the invention in a partially assembled stage.
Figure 2B:
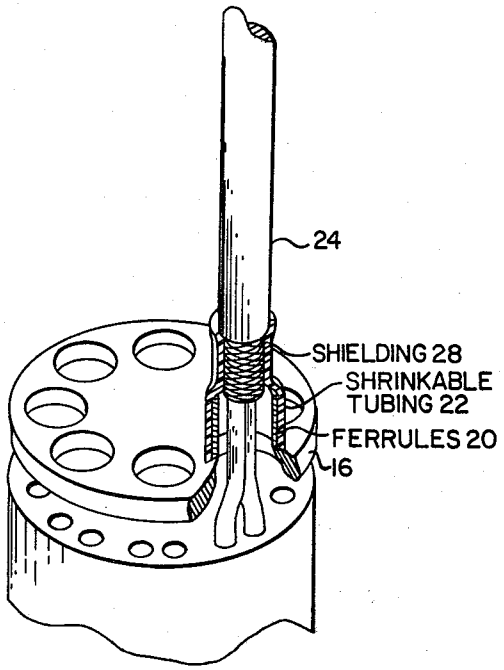
FIGS. 2A and 2B are perspective views showing the details of the assembly of a portion of the invention.
Figure 2A:
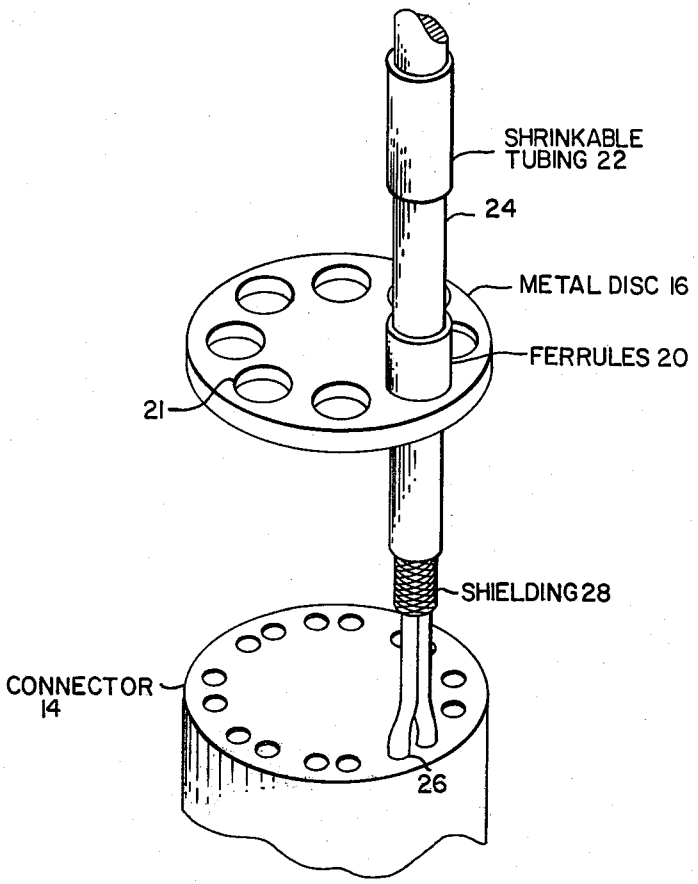
Figure 3:
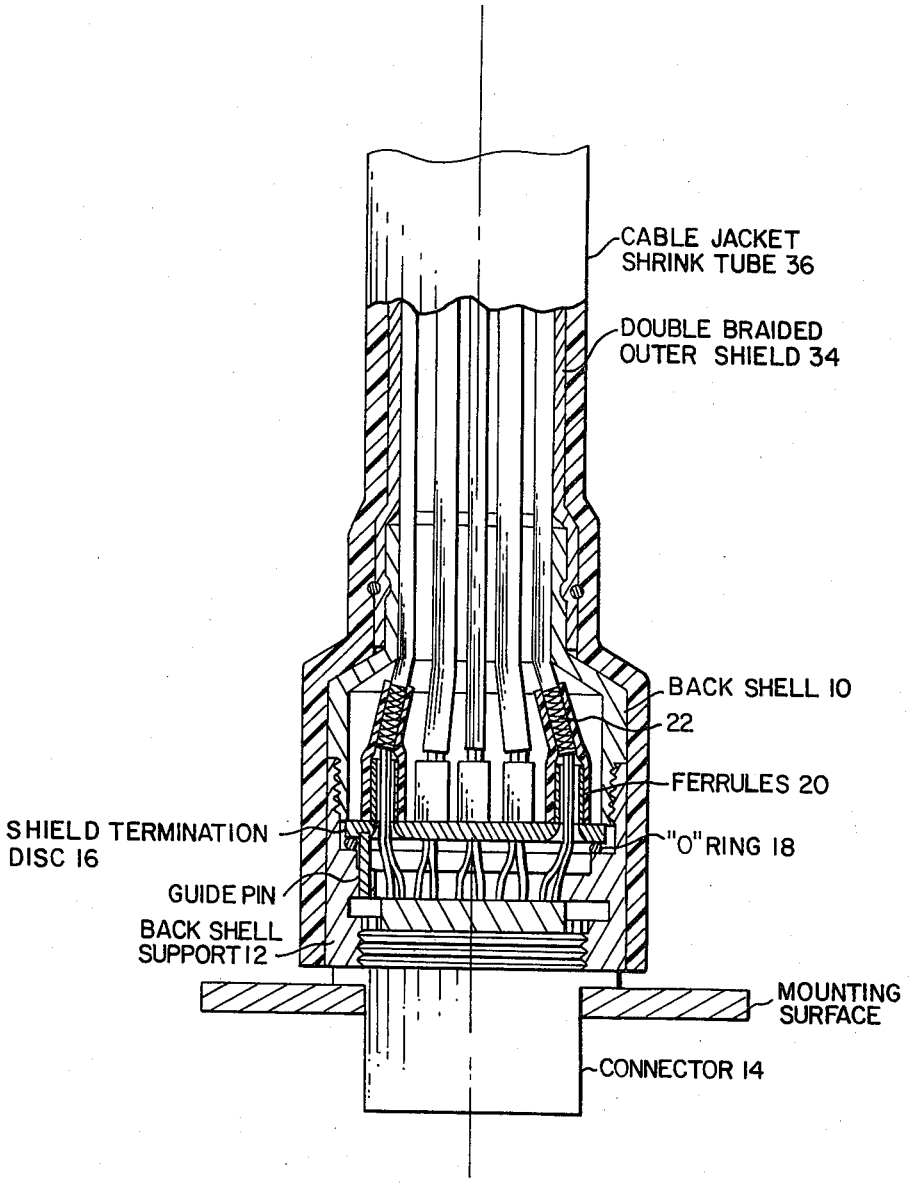
FIG. 3 is a sectional view of the invention in an assembled state.

Referring now to FIGS. 1, 2, and 3, the details of a first embodiment of the invention may be described in detail.

In accordance with the invention, a connector backshell is fabricated in two metal sections 10 and 12 which may be held together by screw threads 120 and 122. The forward section 12 of the backshell threads onto the body of a standard connector 14 by means of threads 124.

A circular metal disc 16 is adapted to be disposed on a rubber "O" ring 18. "O" ring 18 is seated in a groove on a shoulder machined around the inside of forward section 12.

To secure the rear and forward sections together, the rear backshell section 10 is threaded onto the forward section 12 and then tightened down. When tightened down, a circumferential pressure is applied to the disc 16 thereby forming good ohmic contact around the periphery of the disc and between the forward and rear backshell.

The disc 16 is machined and drilled to accomodate ferrules 20. A hole 21 is drilled in the disc for each shielded cable and a ferrule is inserted in each hole. The ferrules 20 are light press-fit into the holes in the disc and protrude to the rear of the backshell approximately $\frac{3}{8}''$. The ferrules consist of metallic tubular members having an outer diameter sufficient to be press-fit into the holes 21 in disc 16 and an inner diameter sufficient to permit passage of the shielded wires.

The disc 16 with ferrules 20 in place is dip-brazed so that the ferrules make good ohmic contact with the disc.

Next, shrinkable, conductive lined tubing 22, each approximately $\frac{3}{4}''$ long, are placed over the metal ferrules 20 protruding from the disc and are heat shrunk to the ferrules. Cable wires 24 are then fed through the rear backshell section 10, through the shrink tubes 22 and ferrules 20, through the "O" ring 18 and thence through the forward backshell section 12. The wires, consisting of inner conductors 26 and metallic shields 28, are then stripped to calculated lengths and conductor pins 30 are crimped to the conductors 26 and seated in the connector insert 32. The forward backshell 12 is then threaded to the conductor 14 as shown in FIG. 3.

Next, the forward backshell 12 is filled with potting material (not shown) to a level just below the "O" ring 18. The potting material is then cured.

After the potting material is cured, the disc 16 is pushed down the wires and seated on the "O" ring 18. The shields 28 of the wires 24 have been previously cut such that when the disc 16 is seated, the shield ends are approximately 1/32" from the ends of the ferrules 20.

Now, the tubing 22 is completely heat-shrink to join the wire shields 28 to the ferrules 20 via the conductive lining inside the tubing 22. The rear backshell section 10 is now threaded to the forward backshell section 12, thereby making a continuous solid low ohmic circumferential electrically conductive connection between wire shields 28, disc 16 and the inner walls of the backshell.

Additional potting material (not shown) is then inserted through the cable entrance of the rear backshell section 12 and cured. The other end of the cable may then be assembled in the same manner.

Finally, the outer shields 34 and jacket 36 are applied to the cable and backshell by well-known methods as shown in FIG. 3.

Figure 4:
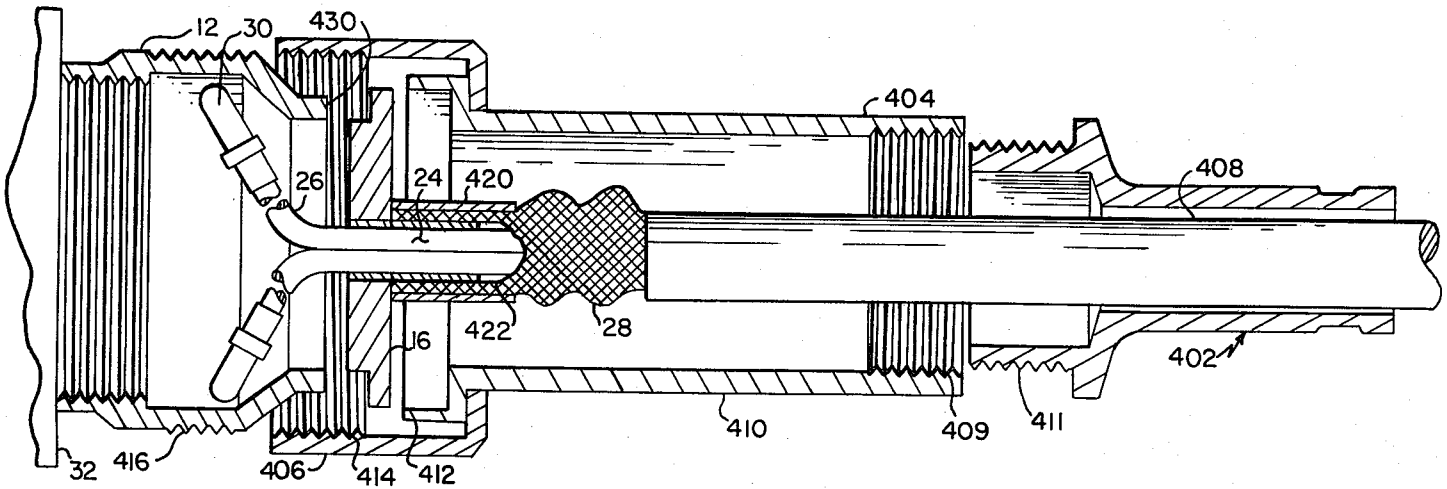
FIG. 4 is a simplified sectional view of an alternate embodiment of the invention.

An alternate embodiment of the invention is illustrated in FIG. 4, which is a simplified cross-sectional view of the invention. It should be understood in connection with FIG. 4 that for purposes of illustration, only one shielded conductor and hole is shown. It is contemplated that numerous such conductors would be included in a commercial device. Also parts corresponding to those already considered in connection with FIGS. 1–3 are similarly numbered in FIG. 4.

In the apparatus of FIG. 4, the unitary backshell member 10 of FIG. 3 is replaced by a three-piece metallic assembly consisting of strain relief member 402, backshell body member 404, and retaining nut 406. Strain relief member 402 is tubular in shape and has an inner diameter sufficient to accomodate cable 408. Member 402 screws into one end of backshell member 404 by means of threads 409 and 411. Member 402 may be fabricated with a right angle section to accomodate cables entering orthogonal to the connector or can be straight-ended as shown in FIG. 4 or may be especially designed in any shape to accomodate the angle of incidence of the cable 408 so as to afford stress relief of the cable.

Metallic backshell 410 is tubular in shape with a flat grooved portion 412 at one end having an inner diameter sufficient to enable aluminum grounding disc 16 to be seated therein.

A metal retaining nut 406 slips over the outside of backshell 410 and secures the backshell support 12 by means of screw threads 414 and 416.

Each conductor 24 within cable 408 (only one of which is shown in FIG. 4) is provided with a metallic braided shield 28 which is filled with an emission suppression polymer material which is capable of at least partially desolving gamma radiation. This material is not a very good electrical conductor. It is desirable to shield the cable 24 from external electrical signals by grounding or providing low impedance continuity from shield 24 to the outer casing of backshell 410 and then to electrical ground potential. In the apparatus of the present invention, this capability is provided by means of a pair of tubular metallic elements or ferrules 420 and 422 which affix the shield to aluminum disc 16.

Ferrule 422 is referred to as the inner ferrule and is provided with knurls on its external surface and is press-fit into a hole or opening provided in grounding disc 16 and the assembly is then dip-brazed to provide good low ohmic contact. Ferrule 420 is the outer ferrule and has an interior diameter sufficient to accomodate the shield wire 28 rigidly between it and inner ferrule 422 as shown in FIG. 4.

This is accomplished as follows: a sufficient length of shield arm 28 is exposed on cable 408 and the nonconductive filler removed. Conductors 24 are passed through inner ferrule 422 while retaining the wire shield 28 over the exterior surface of the inner ferrule 422. The leads 26 are cut to length and connector pins or sockets crimped on the leads.

Next, the outer ferrule 420 is slid down over the shield 28 onto the inner ferrule 422 so as to retain the shield in a tight press-fit against the knurled external surface of inner ferrule 422 thereby establishing good low-ohmic contact between the shield and the inner ferrule. The disc 16 is then pushed upward compressing the shield 28. The pins 30 are then inserted in connector insert 32. The disc 16 is pulled downward stretching shield to its original length. Retaining nut 406 may then be tightly secured to backshell support 12 thereby urging disc 16 against the circumferential lip 430 of support 12 and rigidly holding the periphery of the disc in low-ohmic contact therewith.

It should be noted that outer ferrule 420 may be made of cryogenic material manufactured by Raychem Corp. under the tradename CRYOCON. This material expands when cooled and may thus be placed over the conductor while cool and pressed over the shield and inner ferrule and allowed to reach room temperature thereby contracting and rigidly securing the shield to the inner ferrule.

Figure 5:
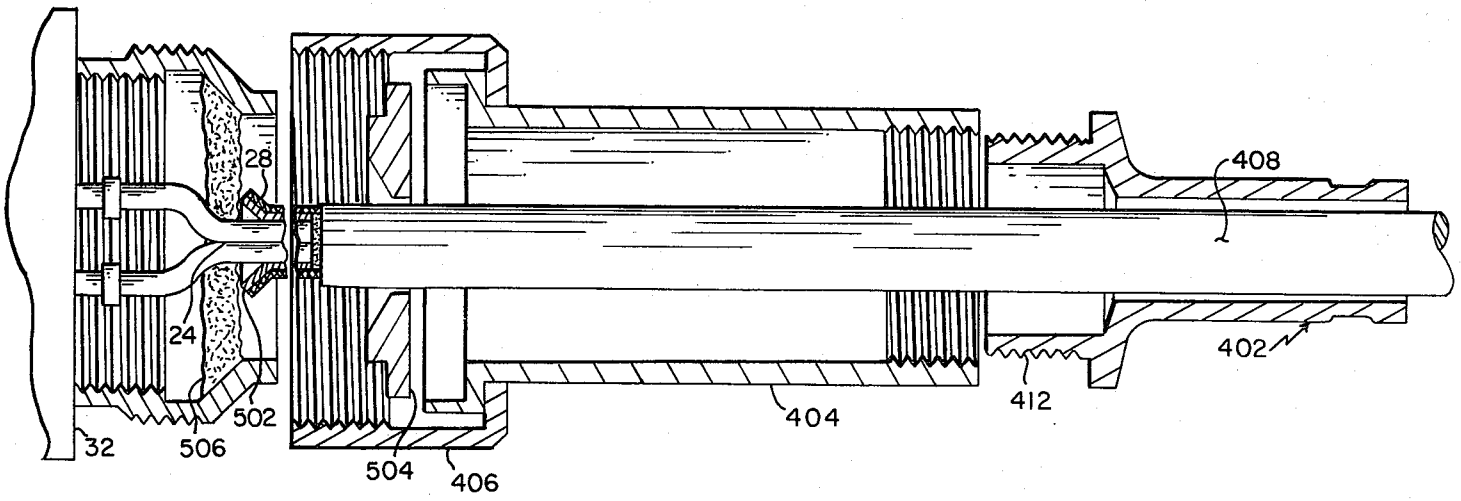
FIG. 5 is a simplified sectional view of a further embodiment of the invention.

A further embodiment of the invention is illustrated in FIG. 5 which has the additional improvement of avoiding the dip brazing process. Parts corresponding to those already described and illustrated in FIGS. 1–4 are correpondingly numbered in FIG. 5 and need not be further described herein.

In the apparatus of FIG. 5, aluminum disc 504 is provided with a plurality of holes to accomodate a plurality of cables 408 only one of which is shown. The holes in disc 504 are flared on one side so as to establish a tight fit with metal ferrule 502 (which is correspondingly flared on one end) when shield wire 28 is placed over the tubular exterior surface of ferrule 502. Knurled ferrule 502 with the shield wire 28 over it is press fit into the flared hole in disc 504 thus making good low-ohmic contact between shield, ferrule, and disc. The assembly is then fastened together as in FIG. 4 after potting material 506 inserted and cured as shown in FIG. 5.

This completes the description of the preferred embodiments of the invention. Those skilled in the art may recognize other equivalent embodiments to those described herein; which equivalents are intended to be encompassed by the claims attached hereto.

I claim:

1. Connector apparatus comprising:

(a) at least one insulated electrical conductor, having a braided wire shield disposed along the length of the insulated conductor;

(b) a planar electrically conductive member, having at least one hole disposed on the planar surface of said member;

(c) a first tubular electrically conductive element adapted to be mechanically held in said hole in low-ohmic contact with said planar member, the inner diameter of said first element being large enough to enable the insulated conductor to pass through;

(d) connecting means for electrically connecting the braided wire shield directly to the first element and thereby directly on said planar conductive member;

(e) a support member disposed coaxial around the planar conductive member; and (f) fastener means for rigidly affixing the periphery of said conductive member in low-ohmic contact with the support member.

2. The apparatus of claim 1 in which the connecting means comprises a heat shrink tube having an inner conductive surface, said tube being disposed at one end over the braided wire shield and at the other end over the outside surface of the tubular elements and heat shrunk thereon.

3. The apparatus of claim 1 in which the connecting means comprises a second tubular conductive element affixed over the braided wire shield and the outside surface of the first element thereby to affix the wire shield in low-ohmic contact with said first element.

4. The apparatus of claim 1 in which the first element is flared at one end and is adapted to be disposed in the hole in said planar member after the wire shield is disposed coaxial to the outer surface of said first element thereby to affix the wire shield in between the edge of said hole and the outer surface of the first element in low-ohmic contact therewith.

5. The method of grounding the wire shields on insulated conductors to a connector having a connector insert positioned in the body of the connector comprising the steps of:

(a) stripping the wire shield to an appropriate length and exposing the conductor wires;

(b) passing an electrically conductive tubular member over the wire shield;

(c) inserting the conductors through first ferrules mounted directly on a planar disk;

(d) placing the wire shield around one end of the ferrules;

(e) affixing the tubular member over the wire shield on the ferrule whereby the wire shield is held in direct low-ohmic contact against the ferrule and said planar disk;

(f) affixing said conductor to the connector insert; and (g) placing said planar disk over the connector insert so that the planar disk is in low-ohmic and shielding contact with said body of the connector.

6. The method of claim 5 in which the conductive tubular member consists of flexible heat shrink tubing with inner electrically conductive lining.

7. The method of claim 5 in which the conductive tubular member consists of a second rigid ferrule which is press-fit over the wire shield and first ferrule.

* * * * *

UNITED STATES PATENT AND TRADEMARK OFFICE

CERTIFICATE OF CORRECTION

PATENT NO. : 4,382,653

DATED : May 10, 1983

INVENTOR(S) : Linden O. Blanchard

It is certified that error appears in the above-identified patent and that said Letters Patent are hereby corrected as shown below:

Column 4, line 8, please change "arm" to --wire--

Signed and Sealed this

Sixth Day of September 1983

[SEAL]

*Attest:*

GERALD J. MOSSINGHOFF

*Attesting Officer*

*Commissioner of Patents and Trademarks*